US007337999B2

(12) United States Patent
Kim

(10) Patent No.: US 7,337,999 B2
(45) Date of Patent: Mar. 4, 2008

(54) DOCUMENT SHREDDER WITH A CONTINUOUSLY WOUND VINYL BAG

(75) Inventor: Bum Kee Kim, Corona, CA (US)

(73) Assignee: Sinclair Worldwide, Inc., Ontario, CA (US)

( * ) Notice: Subject to any disclaimer, the term of this patent is extended or adjusted under 35 U.S.C. 154(b) by 130 days.

(21) Appl. No.: 11/258,172

(22) Filed: Oct. 26, 2005

(65) Prior Publication Data

US 2007/0075170 A1 Apr. 5, 2007

(30) Foreign Application Priority Data

Sep. 30, 2005 (KR) ..... 10-2005-0092076

(51) Int. Cl.
*B02C 18/16* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS 5,538,193 A * 7/1996 Takahashi et al. ..... 241/33

FOREIGN PATENT DOCUMENTS

JP 2000-316408 * 11/2000
KR 2001090658 * 10/2001

* cited by examiner

*Primary Examiner*—Mark Rosenbaum
(74) *Attorney, Agent, or Firm*—Jean C. Edwards, Esq.; Akerman Senterfitt

(57) ABSTRACT

A document shredder with a continuously wound vinyl bag, includes a shredding portion, a collection portion and a cover case. The shredding portion includes an intermediate plate having a drop opening through which the shredded strips of paper fall, and in which a control circuit is mounted, and a pair of cutting rolls disposed above the drop opening, and a top member including a feed opening disposed above the cutting rolls. The collection portion placed downward from the shredding portion, includes a housing frame of which the center is opened, and a roll unit of a vinyl bag in which the paper to be shredded is collected. The cover case includes a support board, side walls which are vertically elevated along three surfaces of the support board, a door in which the vinyl bag filled with the shredded strips of paper is cut and discharged, and the top member which is assembled with the upper portions of the side walls and the door.

11 Claims, 5 Drawing Sheets

DOCUMENT SHREDDER WITH A CONTINUOUSLY WOUND VINYL BAG

This application claims priority from Korean Patent Application No. 2005-92076, filed Sep. 30, 2005, the entire contents of which are herein incorporated by reference to the extent allowed by law.

BACKGROUND OF THE INVENTION

The present invention relates to a document shredder with a continuously wound vinyl bag, and more particularly, to a document shredder with a continuously wound vinyl bag which can cut the destroyed paper into narrow strips or chips and simultaneously collect the shredded strips in the vinyl bag.

Conventionally, there have been known cutting apparatuses for shredding paper documents having only a shredding function and garbage containers with a collection bag therein.

The conventional cutting apparatus for a document shredder which cuts the paper into narrow strips or chips, is provided with only a loading portion for receiving the shredded strips of destroyed paper. When the shredded strips are loaded in excess of the shredder's capacity the shredded strips should be transferred to a garbage bag for disposal by manual labor. Therefore, there is the inconvenience that the shredded strips of the paper may be scattered indoors and the scattered strips should be swept up in the course of collection, and also that such course of action may pollute the indoor air due to fine dirty materials. Accordingly, there is a need for a document shredder which can allow the shredded strips of the destroyed paper documents to be automatically housed in a collection bag without scattering after the paper documents are shredded.

SUMMARY OF THE INVENTION

In order to solve the above problem, an object of the present invention is to provide a document shredder with a continuously wound vinyl bag which can cut the destroyed paper into narrow strips or chips and simultaneously collect the shredded strips in the continuously wound vinyl bag as soon as the paper is shredded.

In order to achieve the above object, there is provided a document shredder with a continuously wound vinyl bag, including:

a shredding portion; a collection portion, placed downward from the shredding portion, including a housing frame of which the center is opened, and a roll unit of a vinyl bag which is inserted into the housing frame so that destroyed paper to be shredded in the shredding portion is collected in the vinyl bag; and a cover case.

It is preferable that the shredding portion includes an intermediate plate which includes a drop opening in which a control circuit is mounted; a pair of cutting rolls disposed above the drop opening in the intermediate plate, which is controlled by the control circuit; and a top member including a feed opening disposed above the cutting rolls.

It is preferable that the cover case includes a support board, side walls which are vertically elevated along three surfaces of the support board, a door in which the vinyl bag filled with the shredded strips of the paper is cut and discharged, and the top member of the shredding portion which is assembled with the upper portions of the side walls and the door, including the feed opening.

It is preferable that the housing frame includes an opening at the center thereof, vertical walls elevated from the bottom thereof, and a lower edge which horizontally extends from the bottom of the vertical walls.

It is preferable that the cover case further includes a locking unit which is horizontally arranged at a predetermined location in the side walls and the door and is joined with the lower edge of the housing frame.

It is preferable that the door is provided with a magnet between the adjacent side walls for attachment/detachment and opening/closing.

It is preferable that the top member further includes an on/off switch.

These and other objects, features, and advantages of the invention will be apparent through the detailed description of the embodiments and the drawings attached hereto. It is also to be understood that both the foregoing general description and the following detailed description are exemplary and not restrictive of the scope of the invention.

BRIEF DESCRIPTION OF THE DRAWINGS

The preferred embodiments are described with reference to the drawings wherein.

DETAILED DESCRIPTION OF THE INVENTION

One embodiment of the present invention will be described in detail with reference to the accompanying drawings.

Figure 1:
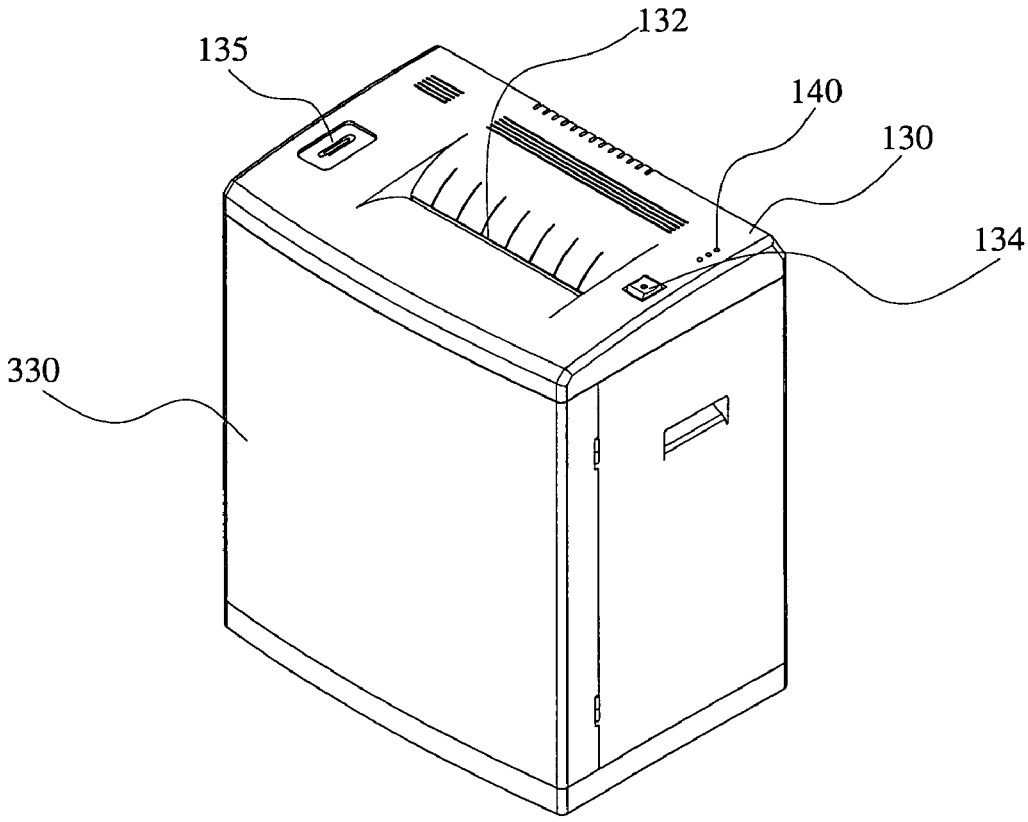
FIG. 1 is a perspective view showing a document shredder with a continuously wound vinyl bag in accordance with the present invention.

FIG. 1 is a perspective view showing a document shredder with a continuously wound vinyl bag in accordance with the present invention.

As shown in FIG. 1, the document shredder with the continuously wound vinyl bag according to the present invention comprises a top member 130, a cover case 300 and a door 330. The top member 130 comprises a feed opening 132, an on/off switch 134, a clip groove 135, and a LED 140. The document shredder is constructed with the cover case 300 having a plurality of top, side and bottom walls and the door 330.

Figure 2:
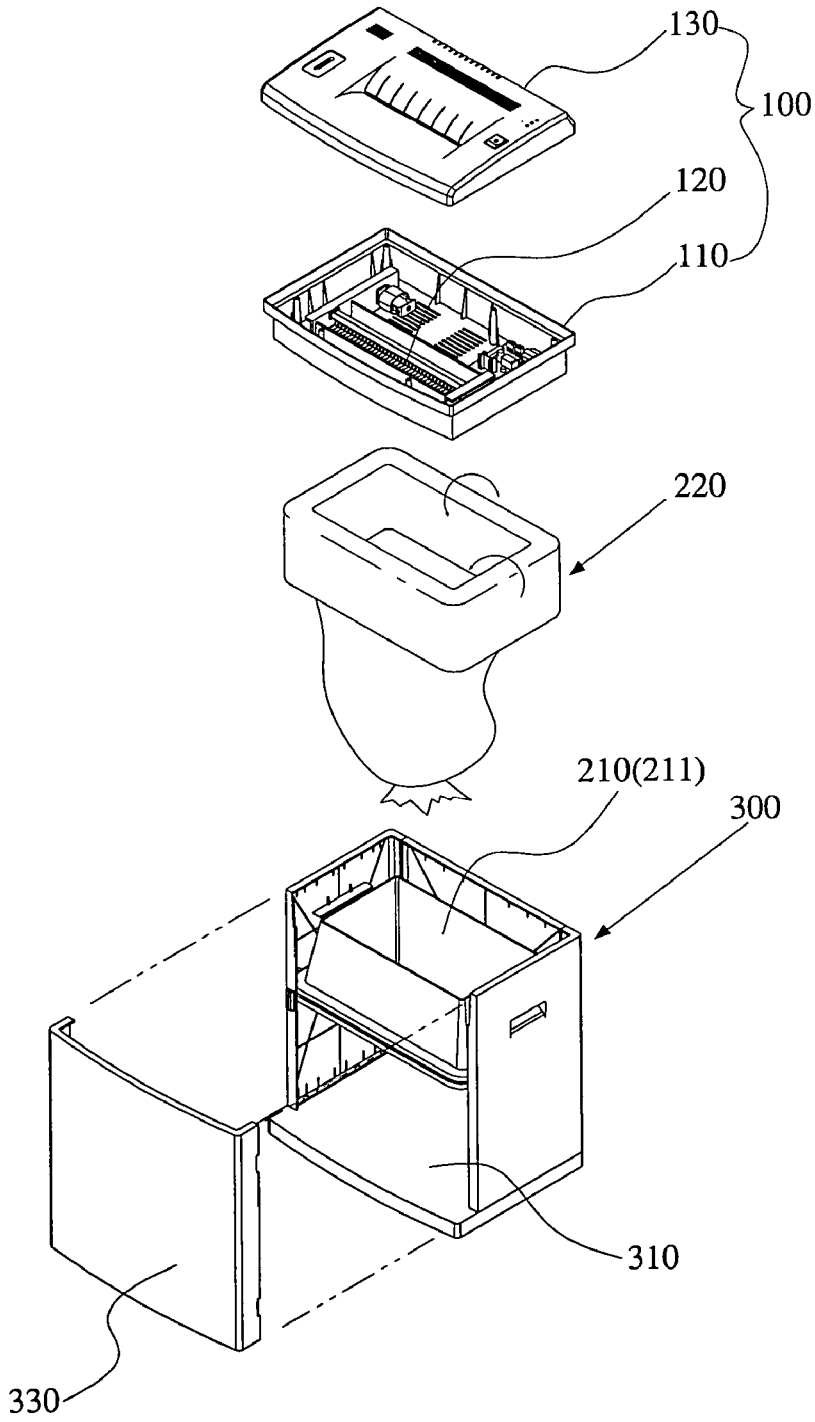
FIG. 2 is a partially exploded perspective view showing a document shredder with a continuously wound vinyl bag in accordance with the present invention.
Figure 3:
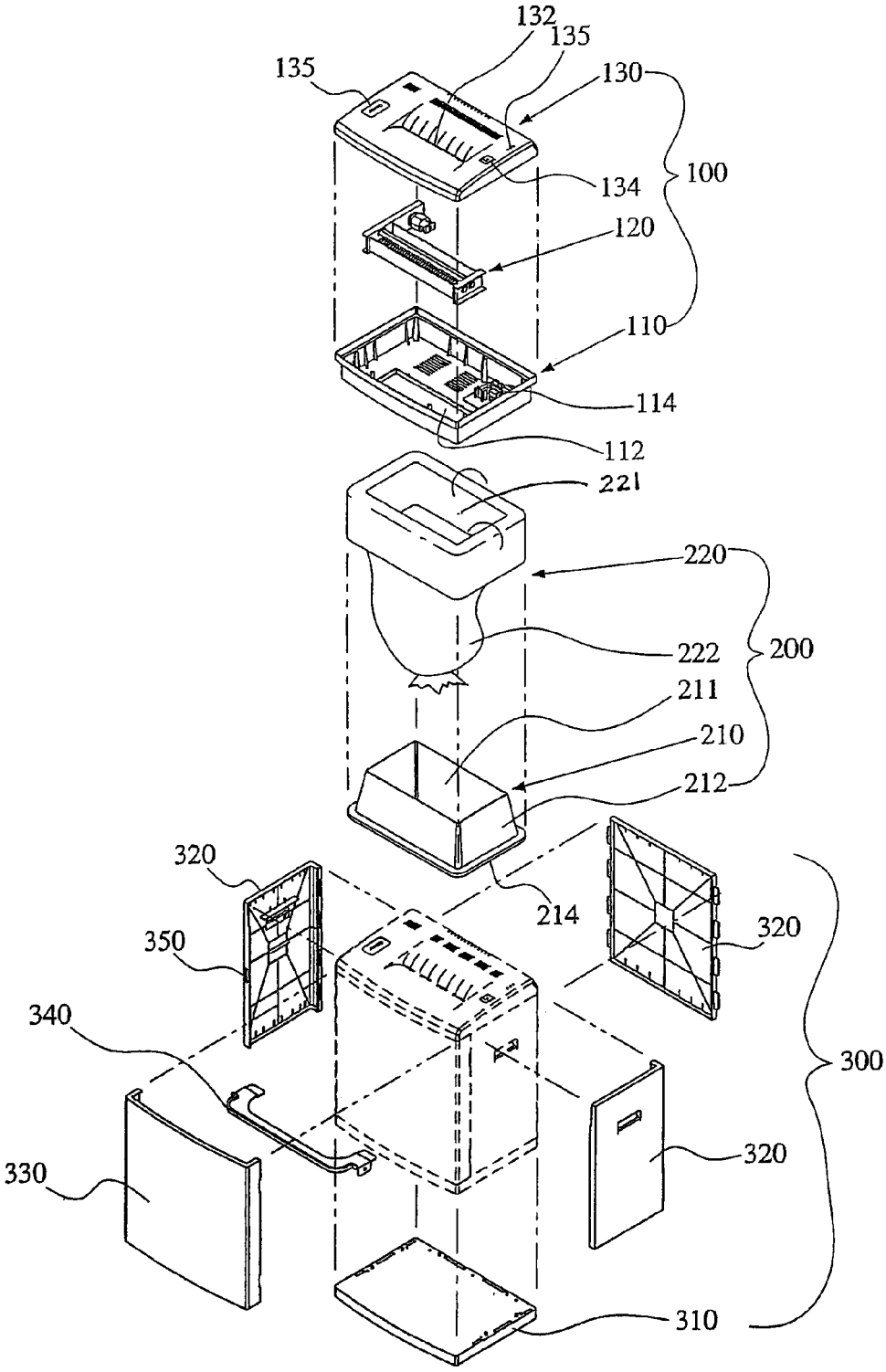
FIG. 3 is an exploded perspective view showing a document shredder with a continuously wound vinyl bag in accordance with the present invention.

FIG. 2 is a partially exploded perspective view showing a document shredder with a continuously wound vinyl bag in accordance with the present invention, and FIG. 3 is an exploded perspective view showing a document shredder with a continuously wound vinyl bag in accordance with the present invention.

Referring to FIGS. 2 and 3, the document shredder with the continuously wound vinyl bag comprises a shredding portion 100, a collection portion 200 and a cover case 300.

First, the shredding portion 100 comprises an intermediate plate 110 which includes a drop opening 112 and in which a control circuit 114 is mounted, and a pair of cutting rolls 120 disposed above the drop opening 112 in the intermediate plate 110, and a top member 130 including a feed opening 132 disposed right above the cutting rolls 120.

The top member 130 includes the feed opening 132, an on/off switch 134, a clip groove 135 and a LED 140.

When the shredded strips of destroyed paper are overloaded in excess of the shredder's capacity, a predetermined upper portion of a continuously wound vinyl bag 222 is cut with a cutting unit formed in the inside of the door 330 or a separate cutting blade (not shown), and is bound and then discharged.

The collection portion 200 which is placed downward from the shredding portion 100, comprises a housing frame 210 of which the center is opened, and a roll unit 220 of the vinyl bag 222 in which the paper strips to be shredded in the shredding portion 100 are collected.

The housing frame 210 includes an opening 211 at the center thereof, vertical walls 212 elevated from the bottom thereof, and a lower edge 214 which horizontally extends from the bottom of the vertical walls, and the lower edge 214 is joined with a locking unit 340.

A cover case 300 comprises a support board 310, side walls 320 which are vertically elevated along three surfaces of the support board 310, a door 330 in which the vinyl bag filled with the shredded strips of the paper is cut and discharged, and the top member 130 which is assembled with the upper portions of the side walls 320 and the door 330, on which the feed opening 132 is provided.

Particularly, the housing frame 210 contains the roll unit 220 of the wound vinyl bag 222. The roll unit 220 is disposed over the housing frame 210 and includes a unit opening 221 that is defined in a center portion thereof and is aligned with the opening 211. The roll unit 220 includes a cavity 224 that is formed along a perimeter of the unit opening 221. The wound vinyl bag 222 is provided in the cavity 224 of the roll unit 220. The wound vinyl bag 222 is dispensed through the housing frame 210 and is bound to form the vinyl bag 222 that collects the shredded material provided from the shredding portion 100. The lower edge 214 of the housing frame 210 is safely fixed at the locking unit 340 which is horizontally arranged at a predetermined inner location of the cover case 300 composed of the side walls 320 and the door 330.

Also, the door 330 is provided with a magnet 350 between the adjacent side walls 320 for attachment or detachment, which may be modified or changed to be hinged or to be provided with a grip.

The document shredder with the continuously wound vinyl bag according to the present invention is vertically elevated with the side walls 320 formed along three surfaces of the support board 310 and the door 330, and the lower edge 214 of the housing frame 210 is safely fixed at the locking unit 340 which is horizontally arranged at the inner position of the cover case 300. Then, the roll unit 220 of the vinyl bag 222 is inserted into the housing frame 210. The intermediate plate 110 is mounted on the housing frame 210. The cutting rolls 120 in the intermediate plate 110 are assembled to fit with the feed opening 132 of the top member 130.

Figure 4:
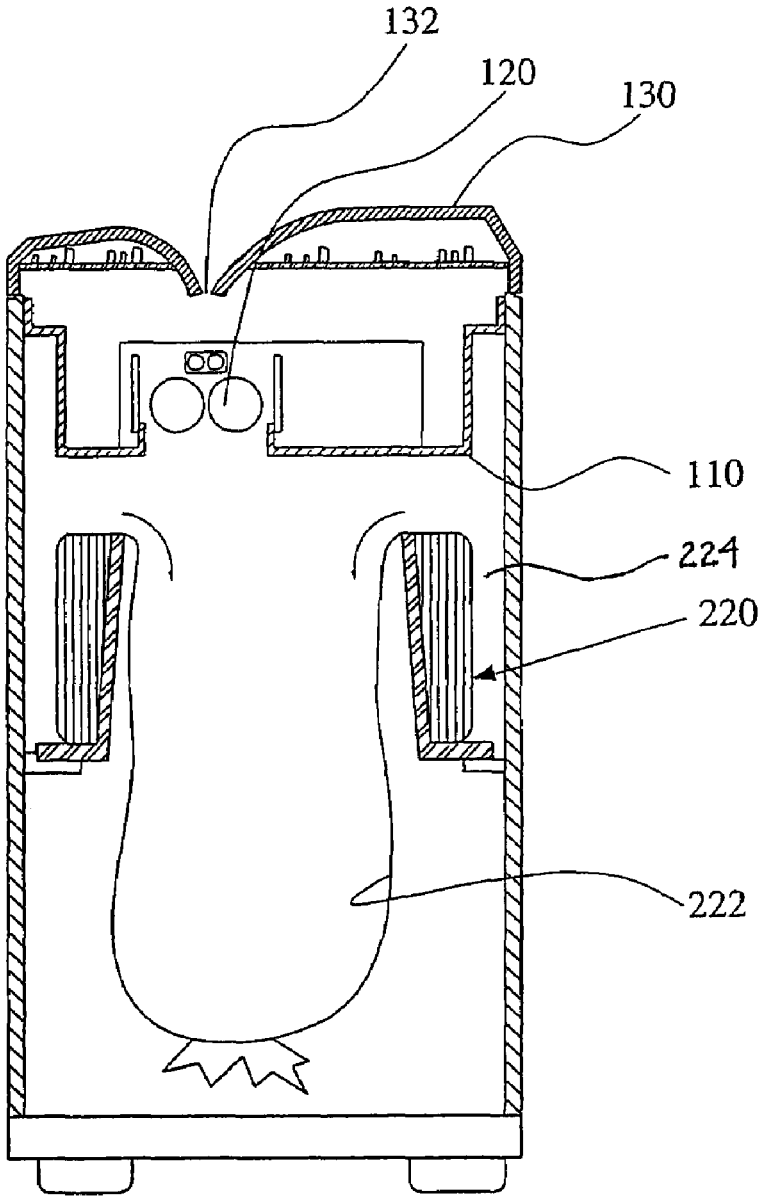
FIG. 4 is a sectional view showing a document shredder with a continuously wound vinyl bag in accordance with the present invention.

FIG. 4 is a sectional view showing a document shredder with a continuously wound vinyl bag in accordance with the present invention. As shown in FIG. 4, the document shredder is supplied with a predetermined power source via operating the on/off switch 134, and a driving motor (not shown) is driven, and then the cutting rolls 120 is rotated with a pulley and belt (not shown).

The number of rotation of the cutting rolls 120 is controlled by the control circuit of the driving motor, but the detailed explanation on an operation of the control circuit will be omitted herein.

At the time when the cutting rolls 120 are rotated by turning the on/off switch 134 on, the destroyed paper is supplied to the feed opening 132, and shredded and then dropped downward.

The shredded strips of the destroyed paper drop, and are automatically collected into the vinyl bag 222 which is arranged in a wound form.

When the shredded strips of the destroyed paper are overloaded in excess of the shredder's capacity, a predetermined upper portion of the vinyl bag 222 is cut, bound and discharged through the door 330. Changes or modifications that the loading of the shredded paper can be detected by a sensor (not shown) and displayed on the top member.

Figure 5:
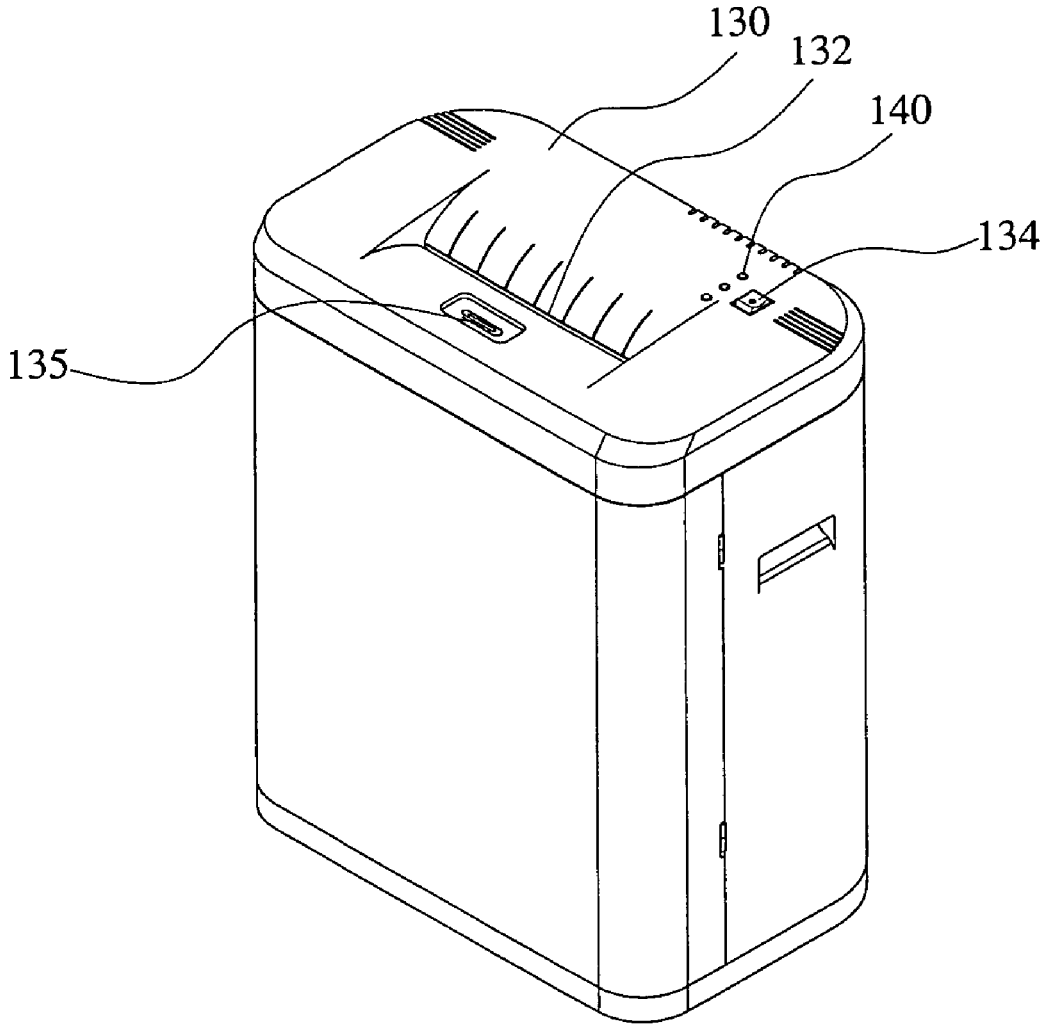
FIG. 5 is a perspective view showing a top member of a document shredder with a continuously wound vinyl bag in accordance with another embodiment of the present invention.

FIG. 5 is a perspective view showing a top member of a document shredder with a continuously wound vinyl bag in accordance with another embodiment of the present invention.

As shown in FIG. 5, a wide range of changes and modifications of the cover case according to the present invention can be made. Also, the technical feature of the present invention is to provide both shredding function and collection function at a same time, by including the continuously wound vinyl bag for collection and disposal.

As described above, the present invention improves a drawback of the conventional document shredder apparatus. At the time when the shredded strips of the destroyed paper drop, they are automatically collected into the vinyl bag without being scattered indoors, and the bag filled with the shredded strips are bound and then discharged. Therefore, the present invention provides the effect to improve the problem of the conventional document shredder apparatus that the shredded strips of the paper loaded in a housing space should be transferred to a separate garbage bag by manual labor.

While only certain embodiments of the invention have been specifically described herein, it will be apparent that numerous modifications may be made thereto without departing from the spirit and scope of the invention.

What is claimed is:

1. A document shredder with a continuously wound vinyl bag, comprising:

a shredding portion that shreds material provided therein;

a collection portion, placed downward from said shredding portion, comprising:

a housing frame that includes a frame opening defined in a center portion thereof and vertical walls that are formed along a perimeter of the frame opening;

a roll unit that is disposed over the housing frame and includes a unit opening defined in a center portion thereof to correspond to the frame opening, the roll unit having a cavity formed along a perimeter of the unit opening;

a material that is provided in the cavity of the roll unit and is dispensed through said housing frame and bound to form a bag that collects the shredded material provided from said shredding portion; and a cover case that encloses the collection portion.

2. A document shredder according to claim 1, wherein said shredding portion comprises:

an intermediate plate which includes a drop opening and in which a control circuit is mounted;

a pair of cutting rolls disposed above the drop opening in the intermediate plate, which is controlled by the control circuit; and a top member including a feed opening disposed above the cutting rolls.

3. A document shredder according to claim 2, wherein said housing frame further comprises a lower edge which horizontally extends from a bottom of the vertical walls.

4. A document shredder according to claim 3, wherein said cover case further comprises a locking unit which is horizontally arranged at a predetermined location in the side walls and the door and is joined with the lower edge of the housing frame.

5. A document shredder according to claim 2, wherein said top member further comprises an on/off switch.

6. A document shredder according to claim 2, wherein said cover case comprises:

a support board;

side walls which are vertically elevated along three surfaces of the support board;

a door for accessing the bag filled with the shredded material to enable the bag to be cut and discharged, wherein the upper portions of the side walls and the door engages the top member of said shredding portion.

7. A document shredder according to claim 6, wherein said door is provided with a magnet between the adjacent side walls for attachment/detachment and opening/closing.

8. A document shredder according to claim 1, wherein said housing frame further comprises a lower edge which horizontally extends from a bottom of the vertical walls.

9. A document shredder according to claim 6, wherein said housing frame further comprises a lower edge which horizontally extends from a bottom of the vertical walls.

10. A document shredder according to claim 9, wherein said cover case further comprises a locking unit which is horizontally arranged at a predetermined location in the side walls and the door and is joined with the lower edge of the housing frame.

11. A document shredder according to claim 8, wherein said cover case further comprises a locking unit which is horizontally arranged at a predetermined location in the side walls and the door and is joined with the lower edge of the housing frame.

* * * * *